United States Patent [19]

Baermann et al.

[11] 4,401,961

[45] Aug. 30, 1983

[54] PERMANENT MAGNETIC HOLDING ARRANGEMENT, PARTICULARLY FOR TEMPORARY HOLDING OF FERRO-MAGNETIC PARTS

[75] Inventors: Horst Baermann, Rösrath; Otmar Dibos, Lohmar, both of Fed. Rep. of Germany

[73] Assignee: Rheinmagnet Horst Baermann KG, Neukirchen, Fed. Rep. of Germany

[21] Appl. No.: 312,261

[22] Filed: Oct. 14, 1981

[51] Int. Cl.[3] ..... H01F 7/20

[52] U.S. Cl. ..... 335/285; 335/302

[58] Field of Search ..... 335/285, 295, 302, 303

[56] References Cited

U.S. PATENT DOCUMENTS 3,095,525 6/1963 Hansen ..... 335/285

4,055,824 10/1977 Baermann ..... 335/295 X

*Primary Examiner*—George Harris

*Attorney, Agent, or Firm*—Body, Vickers & Daniels

[57] ABSTRACT

A permanent magnetic holding arrangement for temporarily holding at least two ferro-magnetic parts wherein the holding of the second part does not decrease the holding of the first part. A disc-shaped permanent magnet magnetized through its smallest thickness is positioned between two pole plates of magnetically permeable material, the thickness of the plates relative to the thickness of the magnet being such that a strong magnetic oversaturation of the plates result. Preferably, the ratio of the pole plate thickness to the permanent magnet thickness is 1:3 or larger.

16 Claims, 3 Drawing Figures

PERMANENT MAGNETIC HOLDING ARRANGEMENT, PARTICULARLY FOR TEMPORARY HOLDING OF FERRO-MAGNETIC PARTS

This invention relates to a permanent magnetic holding arrangement, particularly for temporary and accurately angled holding of ferro-magnetic work pieces, e.g. for connection by welding.

BACKGROUND OF THE INVENTION

Permanent magnetic holding arrangements, particularly for temporary holding of ferro-magnetic work pieces are generally known.

They are comprised of at least one permanent magnet which is magnetized through its smallest thickness. Due to this magnetization the permanent magnet produces a north pole on one surface and a south pole on the opposite surface. Pole plates with good magnetic conductivity or high permeability are fixed to the pole faces of the permanent magnet. They collect the lines of flux emitted by the pole faces of the permanent magnet and conduct these to the holding surfaces.

In most cases, these permanent magnetic holding arrangements have one or two holding surfaces on which the ferro-magnetic parts, e.g. work pieces, adhere to or are held until the work process is completed. If a ferro-magnetic part is placed on the holding surfaces of the pole plates, the magnetic circuit is closed, whereby the lines of flux emitted by the north pole of the permanent magnet pass through one pole plate, through the ferro-magnetic part and return to the south pole of the permanent magnet via the other pole plate.

The strength with which the ferro-magnetic part or work piece is held on the holding surface of the arrangement depends on the size of the adhesive surface (F) linear and the induction (B) square.

If two ferro-magnetic parts are to be held on such a holding arrangement, e.g. on opposite holding surfaces, then the available magnetic flux is divided into two magnetic circuits. In the case of similar quality and nature of the hold part, only half of the magnetic induction is available for each hold part. As the induction in a square effects the holding strength, the holding strength in the case of two hold parts is reduced fourfold.

OBJECTS

In avoiding these disadvantages, it is the object of this invention to provide a holding arrangement, whereby the holding strength is not reduced by placing several ferro-magnetic parts on several holding surfaces of the holding arrangement.

Another object of this invention is to make possible an accurately angled holding of ferro-magnetic parts on the holding surfaces during machining, e.g. during welding.

Another object of this holding arrangement is to provide a simple design, thus keeping production cost low.

THE INVENTION

It has been noted with surprise that the specific holding strength of a permanent magnetic holding arrangement of the aforementioned type is not reduced by placing ferro-magnetic parts on several or all of the holding surfaces, which are at an angle to each other, if the highly permeable pole plates are made so thin that they become oversaturated by the magnetic flux induced by the permanent magnet.

An oversaturation of the pole plates is achieved when the ratio of the pole plate thickness (d) to the permanent magnet thickness (m) is 1:3 or larger, e.g. 1:4 . . . 1:6, etc.

Although several magnetic circuits are available when ferro-magnetic parts are placed on several holding surfaces of the holding arrangement according to the invention, this leading to a division of the flux, there is such a large reserve of magnetic flux in the arrangement according to the invention that a saturation and therefore the maximum induction (B) required for the holding strength is always insured.

DRAWINGS

The invention may take physical form in certain parts and combinations of parts, preferred embodiments of which will be described in detail in this specification and illustrated in the accompanying drawings which are a part hereof and wherein.

PREFERRED EMBODIMENTS

Figure 1:
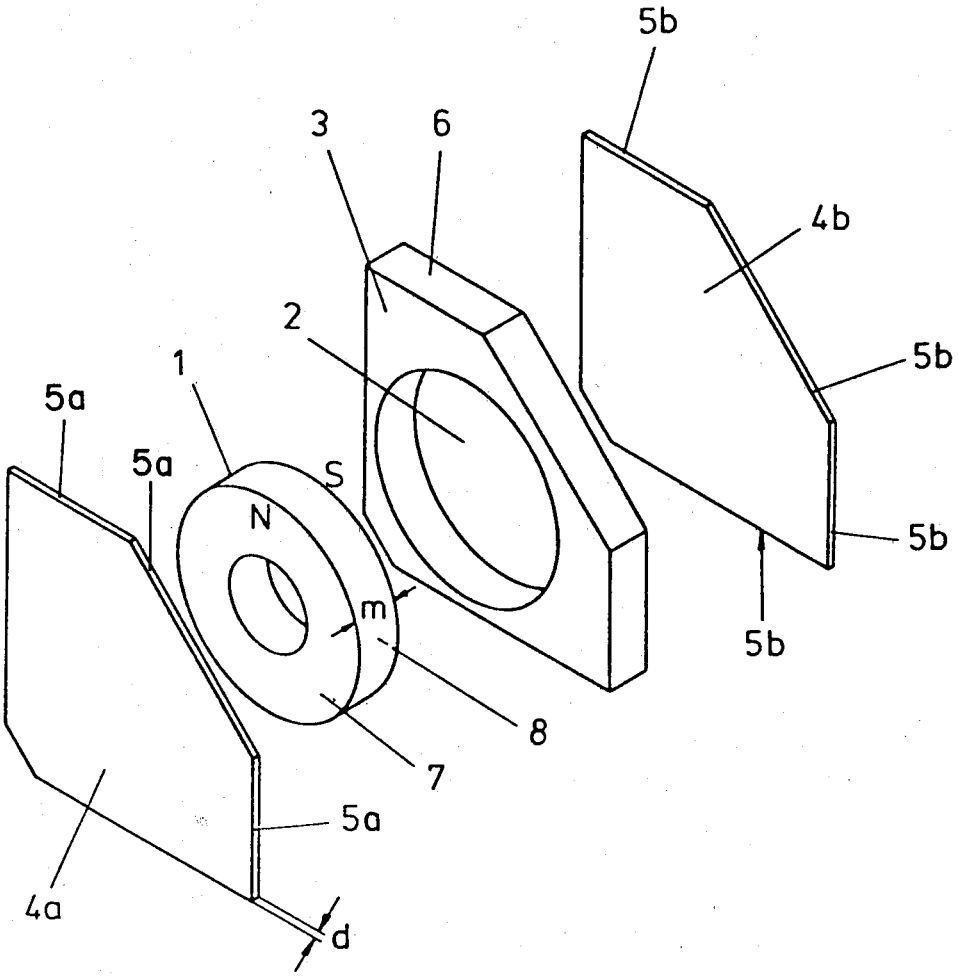
FIG. 1 is an expanded illustration in perspective of the holding arrangement, showing the individual components.

Referring now to the drawings wherein the showings are for illustrating preferred embodiments of the invention only and not for the purposes of limiting same, the holding arrangement according to the invention comprises the disc-shaped permanent magnet 1 which is magnetized through its smallest thickness. The poles on the pole faces 7 and 8 of the magnet are marked in the drawing by the letters N and S. The permanent magnet, which can also take a different form, is positioned flatwise in the correspondingly shaped recess 2 of the plate-shaped plastic body 3. The permanent magnet has the same thickness as the plastic body. After the permanent magnet has been placed in the plastic body, the two pole plates 4*a* and 4*b*, which are made of a highly magnetically permeable material, are fixed to the plastic body, e.g. by gluing as with an adhesive medium, in a position abutting flatwise against the pole faces 7 and 8, respectively, of the magnet 1. The pole plate 4*a* is polarized through the pole surface 7 of the permanent magnet, which has a north pole, while the pole plate 4*b* is polarized by the pole face 8 with south pole magnetization.

The holding arrangement is so formed that it has several periperal edge holding surfaces 5*a* and 5*b* positioned at angles to each other. Thus, as shown, the holding surfaces 5*a* and 5*b* of the pole plates 4*a*, 4*b* also each have at least two adjoining holding edge surface portions correspondingly formed at a right angle and preferably at least two other adjoining edge surface portions correspondingly formed at an angle greater than a right angle. The holding surfaces 5*a* of the pole plate 4*a* produce a north pole and the holding surfaces 5*b* of pole plate 4*b* produce a south pole. When one or several parts of ferro-magnetic material are placed on the various holding surfaces, then these will be held by strong magnetic attraction, whereby the magnetic lines of flux close over the ferro-magnetic part(s).

According to the invention, the pole plates 4*a* and 4*b* are of a very thin material quality so that a strong magnetic oversaturation occurs due to the inducing effect of the permanent magnet 1. This measure insures that in contrast to known holding arrangements, the specific holding strength is not reduced by placing several ferromagnetic parts on the holding surfaces of the pole plates. In the special embodiment, the permanent magnet is made of anisotropic sintered strontium-ferrite. Of course, other ferrous materials such as barium-ferrite may be used. The permanent magnet 1 has a diameter of 60 mm and a thickness (m) of 12 mm. The thickness (d) of the pole plates 4*a*, 4*b* amounts to 2 mm representing a ratio of 1:6 to the magnet thickness (m).

Figure 2:
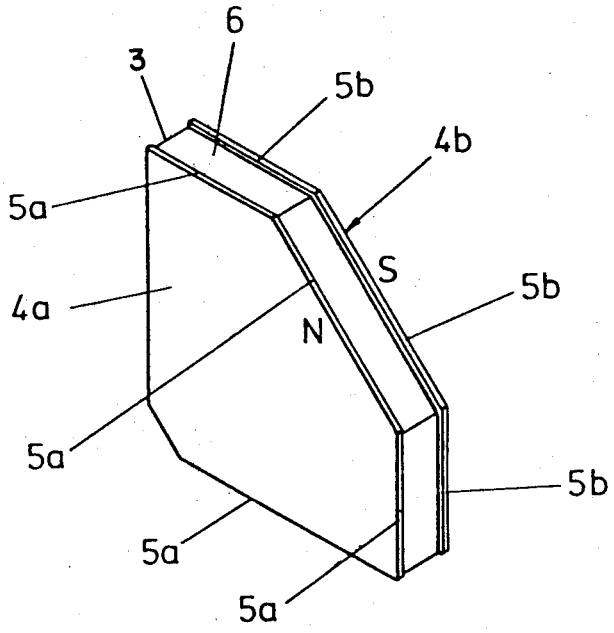
FIG. 2 is an illustration in perspective of the assembled holding arrangement; and, FIG. 3 is another embodiment of the holding arrangement in side view.
Figure 3:
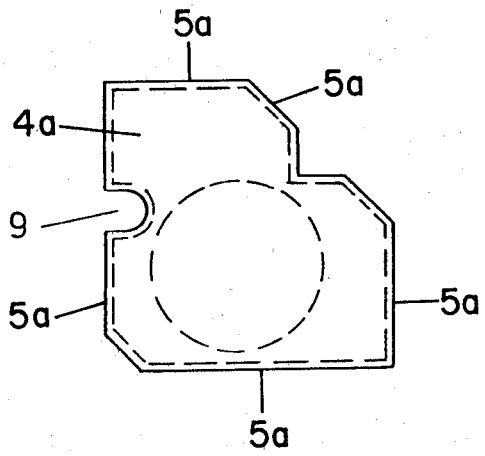

The plastic body 3 preferably is made of a nonflammable, nonmagnetic material, such as phenol resin. As can be seen in FIG. 2, the pole plates 4*a*, 4*b* protrude slightly from the circumferential surfaces 6 of the plastic body 3. This measure enables curved or bent ferromagnetic parts, such as pipes, to be held. Arrangements according to the invention are applied preferably where ferro-magnetic parts, such as sheets, panels, etc., are to be held temporarily at an accurate angle until they can be permanently fixed together, e.g. by welding. Of course, other applications, whereby a temporary holding of the parts for machining is necessary, are also conceivable. The holding arrangement according to the invention can also be provided with recesses 9, preferably in the form of a half-circle, for holding pipes or iron rods having a circular cross section, as can be seen in FIG. 3.

Having thus defined the invention, the following is claimed:

1. A permanent magnetic holding arrangement, particularly for temporary and accurately angled holding of ferro-magnetic work pieces, e.g. for connection by welding, comprising at least one permanent magnet having flat pole faces facing oppositely away from each other and said magnet being magnetized through its smallest thickness between its said pole faces, and at least two pole plates of high magnetic permeability and like thickness abutting flatwise against respective ones of the said magnetized pole faces of the permanent magnet(s), the peripheral edges of said pole plates extending beyond the permanent magnet and forming the magnetized holding surfaces of the holding arrangement of differing polarity, the said pole plates each having several adjoining portions of their said holding edge surfaces correspondingly arranged on the respective pole plates at various large angles to each other, and the thickness of the said pole plates being so selected, relative to the magnetic permeability thereof and the magnetic strength of said permanent magnet(s), as to produce a magnetic oversaturation of the said pole plates through the inducing effect of the said permanent magnet(s).

2. A permanent magnetic holding arrangement according to claim 1 wherein the said pole plates each have at least two adjoining portions of said holding edge surfaces correspondingly formed at a right angle.

3. A permanent magnetic holding arrangement according to claim 1 including a plate-shaped nonflammable plastic body member of the same thickness as said permanent magnet and having an internal recess therethrough, said body member being permanently fastened flatwise to and between the said pole plates and said magnet being positioned flatwise in said recess with its north pole lying against one of said pole plates and its south pole lying against the opposite one of said pole plates.

4. A permanent magnetic holding arrangement according to claim 2 including a plate-shaped nonflammable plastic body member of the same thickness as said permanent magnet and having an internal recess therethrough, said body member being permanently fastened flatwise to and between the said pole plates and said magnet being positioned flatwise in said recess with its north pole lying against one of said pole plates and its south pole lying against the opposite one of said pole plates.

5. A permanent magnetic holding arrangement according to claim 3 wherein the said permanent magnet is disc- or square-shaped and the said plastic body member is fastened to the said pole plates by an adhesive medium.

6. A permanent magnetic holding arrangement according to claim 1 wherein the said permanent magnet is made of antisotropic sintered barium- or strontium-ferrite.

7. A permament magnetic holding arrangement according to claim 3 wherein the said plastic body member is made of a material of the group of non-magnetic plastic materials including phenol resin.

8. A permanent magnetic holding arrangement according to claim 4 wherein the said plastic body member is made of a material of the group of non-magnetic plastic materials including phenol resin.

9. A permanent magnetic holding arrangement according to claim 3 wherein the said pole plates protrude slightly around their peripheral extent from the peripheral surface of the said plastic body member.

10. A permanent magnetic holding arrangement according to claim 1 wherein the ratio of the thickness of each of said pole plates to the permanent magnet thickness is 1:3 or larger.

11. A permanent magnetic holding arrangement according to claim 2 wherein the ratio of the thickness of each of said pole plates to the permanent magnet thickness is 1:3 or larger.

12. A permanent magnetic holding arrangement according to claim 3 wherein the ratio of the thickness of each of said pole plates to the permanent magnet thickness is 1:3 or larger.

13. A permanent magnetic holding arrangement according to claim 5 wherein the ratio of the thickness of each of said pole plates to the permanent magnet thickness is 1:3 or larger.

14. A permanent magnetic holding arrangement according to claim 2 wherein the said pole plates each have at least two other adjoining holding edge surface portions correspondingly formed at an angle greater than a right angle.

15. A permanent magnetic holding arrangement according to claim 4 wherein the said pole plates each have at least two other adjoining holding edge surface portions correspondingly formed at an angle greater than a right angle.

16. A permanent magnetic holding arrangement according to claim 14 wherein corresponding ones of the said other adjoining holding edge surface portions of each of said pole plates are correspondingly formed with a right angle notch the respective sides of which form additional said holding edge surface portions on the respective pole plates.

* * * * *